United States Patent [19]

Shibahara

[11] 4,058,043

[45] Nov. 15, 1977

[54] PROGRAMMABLE RHYTHM APPARATUS

[75] Inventor: Masashi Shibahara, Kishiwada, Japan

[73] Assignee: Nihon Hammond Kabushiki Kaisha, Osaka, Japan

[21] Appl. No.: 627,262

[22] Filed: Oct. 30, 1975

[30] Foreign Application Priority Data

| | | |
|---|---|---|
| Nov. 1, 1974 | Japan | 49-126971 |
| Dec. 11, 1974 | Japan | 49-142929 |
| Dec. 11, 1974 | Japan | 49-142928 |
| Dec. 11, 1974 | Japan | 49-142927 |
| Dec. 11, 1974 | Japan | 49-142926 |

[51] Int. Cl.[2] ..... G10F 1/00; G10H 1/02; A63J 17/00

[52] U.S. Cl. ..... 84/1.03; 84/1.24; 84/DIG. 12; 84/464

[58] Field of Search ..... 84/1.01, 1.03, 1.11, 84/1.19, 1.24, 464, DIG. 9, DIG. 12

[56] References Cited

U.S. PATENT DOCUMENTS

| | | | |
|---|---|---|---|
| 3,629,480 | 4/1970 | Harris | 84/DIG. 12 |
| 3,760,088 | 9/1973 | Nakada | 84/1.24 |

FOREIGN PATENT DOCUMENTS

| | | | |
|---|---|---|---|
| 1,165,070 | 9/1964 | United Kingdom | 84/1.03 |

*Primary Examiner*—E. S. Jackmon
*Attorney, Agent, or Firm*—Neuman, Williams, Anderson & Olson

[57] ABSTRACT

A programmable rhythm apparatus for use with an electronic musical instrument comprising a sequential pulse generator, a plurality of individually programmable rhythm channels or tracks each producing an output pulse pattern in response to the sequential pulse generator and a standard voice generation circuit to receive the pulse output pattern from the programmed rhythm channels. The voice generation circuit produces a signal representative of an unpitched musical instrument with a rhythm pattern corresponding to the pulse output pattern of an individual rhythm channel. The voice generation circuit output signals corresponding to each rhythm channel and representing different unpitched instruments are combined and applied to an audio transducer. Each individual rhythm channel can be programmed by the instrument player to provide a pulse output sequence representative of any rhythm pattern desired. Each rhythm channel has a plurality of logic means and a selection means. The instrument player uses the selection means to set or program various ones of the plurality of logic means to form a pattern corresponding to the desired rhythm. Thereafter, each set logic means produces an output pulse upon receipt of a sequence pulse from the pulse generator. A switching network can be provided between the outputs of the rhythm channels and the input terminals of the voice generation circuit to provide increased flexibility and versatility. Furthermore, the programmable rhythm apparatus can be used in conjunction with the fixed rhythm matrices of the prior art to provide selectable rhythm variation for certain unpitched musical instruments and the standard rhythm for others.

10 Claims, 6 Drawing Figures

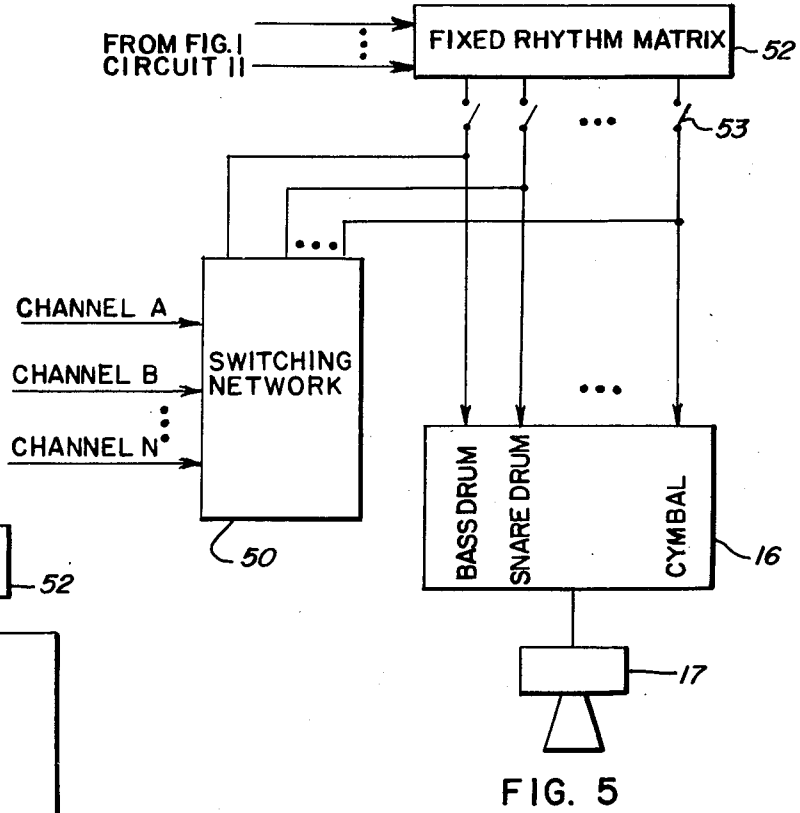
FIG. 5
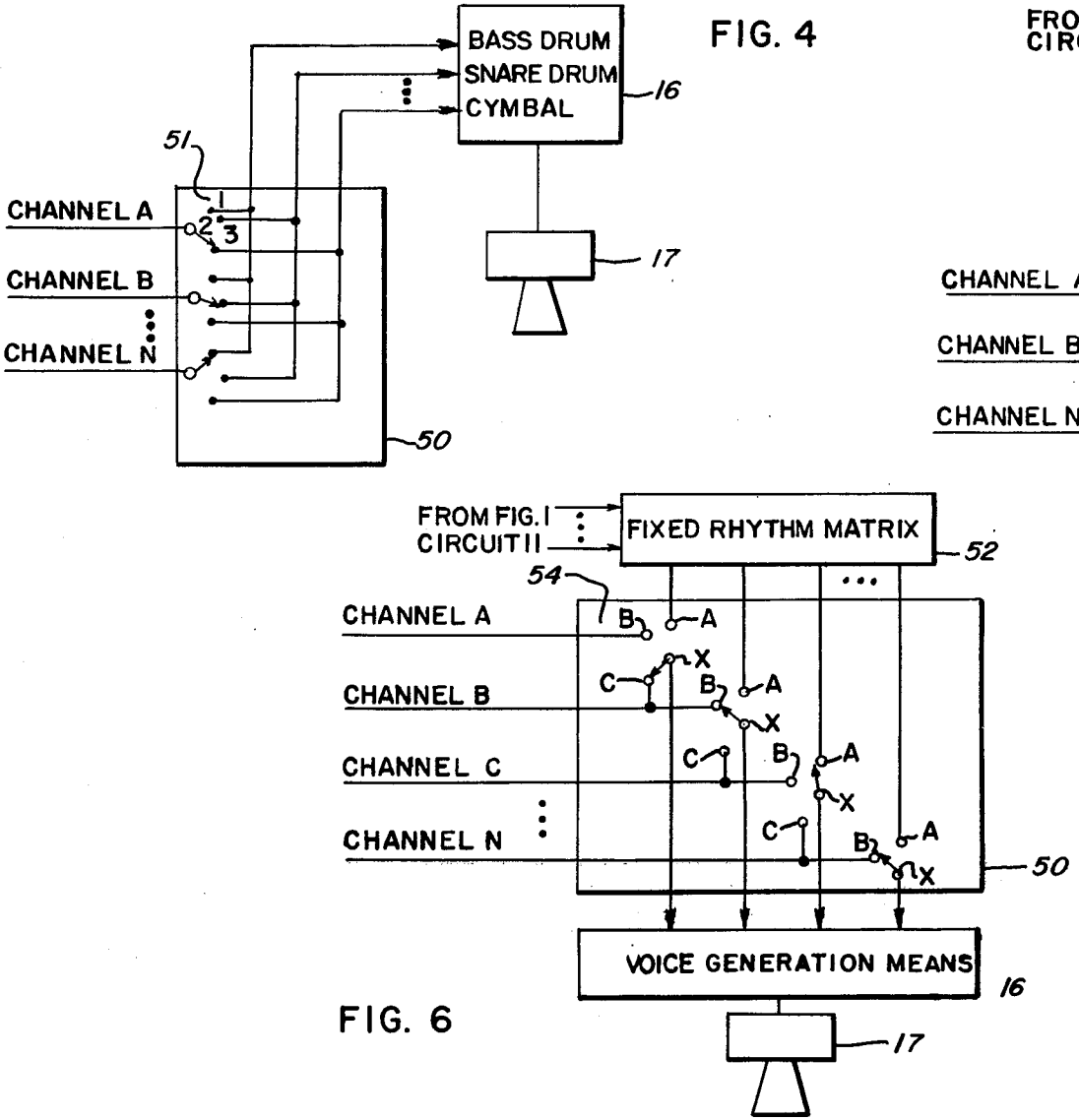
FIG. 4
FIG. 6

PROGRAMMABLE RHYTHM APPARATUS

BACKGROUND

The present invention is directed to a rhythm apparatus for an electronic musical instrument. In prior art systems, an instrument player could select any standard well-known rhythm pattern such as a waltz, mambo or the like and one of a plurality of unpitched musical instrument sounds to be simulated with the selected rhythm pattern. The standard rhythm patterns were predetermined and fixed in a rhythm matrix unit well-known in the prior art so that the instrument player could not alter or vary these rhythm patterns. This type of rhythm apparatus did not provide for any degree of creativity or flexibility by the instrument player to select different rhythm patterns or to alter the standard patterns. Furthermore, the fixed rhythm units required a great amount of storage for the numerous standard rhythm patterns available.

SUMMARY OF THE INVENTION

The present invention is a programmable automatic rhythm device for an electronic musical instrument. A counter circuit provides a repetitive sequence of pulses to a plurality of parallel rhythm channels. The pulse pattern output of each rhythm channel is applied to a separate input terminal corresponding to a particular unpitched musical instrument of a standard voice generation circuit which provides an output signal to a transducer representative of the unpitched musical instrument. The pulse pattern applied to the voice generation circuit and thus the rhythm of the sound produced by the transducer is selectable by the instrument player. Each rhythm channel comprises a plurality of logic circuits to receive the pulse sequence from the counter circuit and a selection means. During the program mode of operation the instrument player actuates the selection means of a particular rhythm channel at the same instant a sequence pulse is applied from the counter circuit to thereby set that logic circuit. In the subsequent play mode, the sequence pulse from the counter circuit which corresponds to a set or programmed logic circuit will cause a pulse output to be applied to the voice generation circuit. The pattern of pulse outputs for a rhythm channel is determined by the pattern of logic circuits previously set by the instrument player. Each succeeding cycle of sequence pulses from the counter circuit will cause the same sequence of output pulses from the rhythm channels to be applied to the voice generation circuit until the rhythm channel is reset.

A switching network can be interspersed between the pulse outputs of the individual rhythm channels and the voice generation circuit. The switching network operates to apply the pulse output pattern of a particular rhythm channel to different input terminals of the voice generation circuit to provide greater flexibility. Furthermore, the apparatus can be used with the fixed rhythm matrix of the prior art. In that case, a plurality of cancel switches are inserted in the output lines from the fixed rhythm matrix and if one of the cancel switches is opened by the instrument player, the standard fixed rhythm pattern is not supplied by the corresponding input terminal of the voice generation circuit. The instrument player can now set any desired rhythm pattern in one of the rhythm channels and apply that pulse output pattern to the input terminal of the voice generation circuit instead of the cancelled standard pulse pattern.

An object of the present invention is to provide a rhythm apparatus which permits the instrument player to select any variation of rhythm patterns desired.

A further object is to provide a rhythm apparatus which retains the programmed rhythm pattern for subsequent use until reset.

An additional object is to provide a rhythm apparatus with a plurality of programmable rhythm channels for use in conjunction with a switching network to provide a variation of connections for each rhythm channel to a voice generation circuit.

An additional object is to provide a rhythm apparatus with plurality of programmable rhythm channels for use in conjunction with a fixed rhythm matrix.

BRIEF DESCRIPTION OF THE DRAWINGS

Further and additional objects will appear from the following detailed description of a specific embodiment read in conjunction with the accompanying drawings, wherein:

FIG. 4 is an alternative embodiment of the programmable rhythm apparatus including a switching network;

FIGS. 5 and 6 are alternative embodiments of the programmable rhythm apparatus including a fixed rhythm matrix and a switching network.

DETAILED DESCRIPTION OF THE INVENTION

Figure 1:
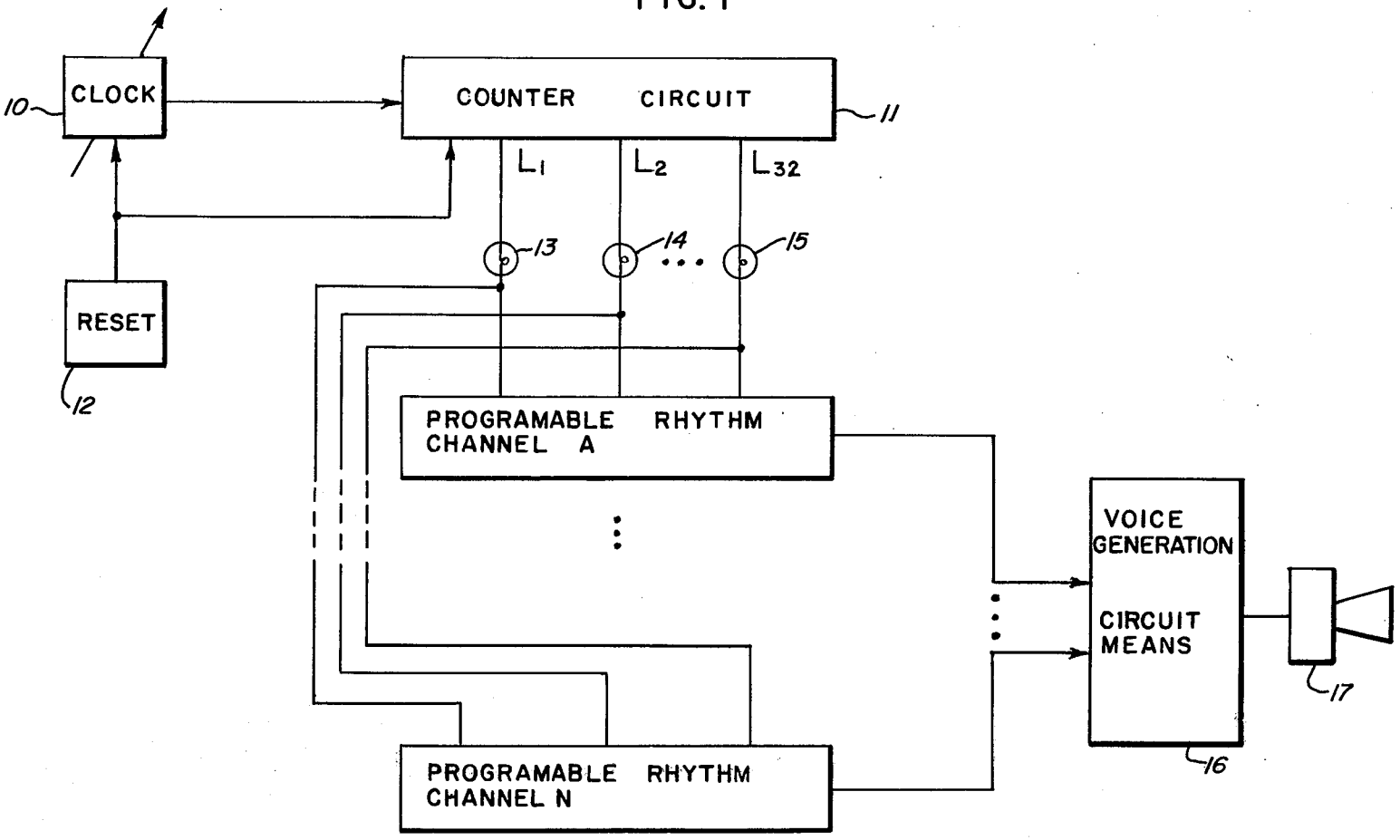
FIG. 1 is a system block diagram of the programmable rhythm apparatus of the present invention.

FIG. 1 illustrates the general structure of the automatic programmable rhythm device. A variable frequency clock pulse oscillator 10 drives the sequential pulse generating circuit 11. The circuit 11 can be any form of electrical circuit means which will repetitively produce a plurality of sequential output pulses on a predetermined number of lines, in the preferred embodiment of a standard counting circuit with 32 output terminals or lines is used. It should be apparent that the number of output terminals can be varied. A switch 12 is connected to both the clock 10 and the counter circuit means 11. The switch 12 in addition to controlling the on/off condition of the clock 10 resets the counter 11 so that the pulse output sequence will always begin at the first line L1. As the first in the series of sequential pulses from the counter means 11 appears on line L1, the corresponding lamp 13 is energized. As the next succeeding pulse appears on line L2, the lamp 13 will go out and lamp 14 becomes energized. The above procedure continues for each succeeding pulse output of the circuit 11 concluding with the final pulse on line L32 energizing lamp 15. The pulse output sequence now repeats beginning at line L1. The pulse appearing on line L1 and on each succeeding line is applied to each of a plurality of programmable rhythm channels A through N. The outputs of each individual rhythm channel A through N corresponding to its individually programmed rhythm pattern are applied as control signals to the input terminals of a standard voice generation circuit means 16 which produces a corresponding signal output representative of unpitched musical instruments such as a snare drum, cymbal, or the like. The voice generation circuit means is standard and well-known in the art and further description thereof is considered unnecessary. It should be apparent that the control signal outputs of the rhythm channels could be used for other purposes such as to gate tone signals generated in response to normal playing on a keyboard of an electronic musical instrument. A transducer 17 is responsive to the output of the voice generation circuit 16 to produce an audible signal similar to the unpitched musical instruments and with a rhythm pattern corresponding to the respective programmed channels A through N. Each rhythm channel is programmable by the instrument player to pass to a corresponding terminal of the voice generation circuit 16 a selectable number of the pulses it receives on lines L1 through L32 respectively. Thereby, the instrument player can preselect by determining the number and time interval between the pulses the rhythm of the representative unpitched musical instruments that he desires to be heard by the listener.

Figure 2:
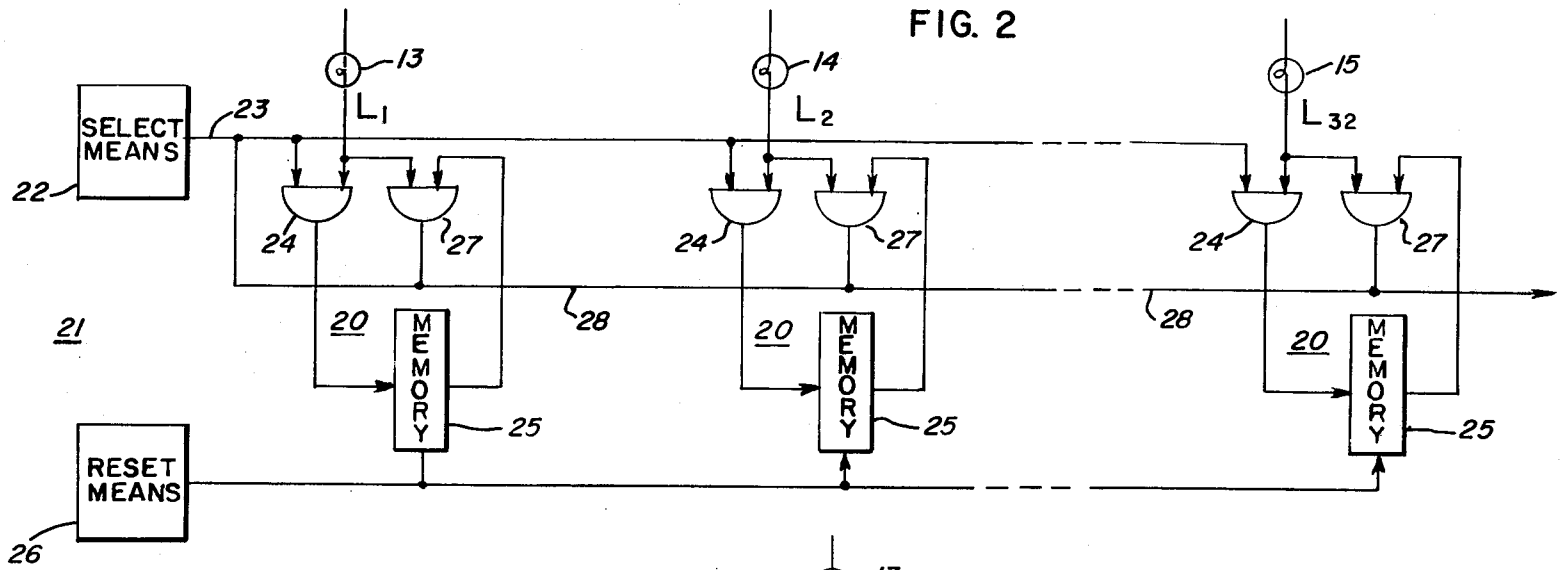
FIG. 2 is a schematic illustration of an individual programmable rhythm channel.

FIG. 2 illustrates the circuit of an individual programmable rhythm channel. Each rhythm channel A through N comprises a plurality of logic circuit means 20 which respectively correspond to the number of output lines of the counter circuit 11. The same numerals are used to refer to identical components in each logic circuit means 20. Each rhythm channel further comprises a single selection means 21. Each logic circuit 20 is responsive to the output pulses of the selection means 21.

To program a desired rhythm output of an individual channel, the instrument player sets certain ones of the plurality of logic circuits 20 to have a signal output pulse upon receipt of a corresponding sequence pulse from the pulse sequence output of counter circuit 11 (not illustrated in FIG. 2). The instrument player programs the desired rhythm by depressing switch 12 of FIG. 1 which resets counter 11 and turns clock 10 on. The clock 10 drives the circuit 11 to produce a first pulse on line L1 energizing lamp 13. If the instrument player desires to set the first logic circuit 20 corresponding to line L1, he activates switch means 22 of the selection means 21 while lamp 13 is lit. The switch means 22 will produce a pulse output on line 23. The switch means 22 can be a simple momentary contact switch for connecting a pulse source to line 23 or any well-known circuit to produce a pulse output upon activation such as the combination of a capacitive touch plate, oscillator and rectifier disclosed in the inventor's co-pending U.S. application Ser. No. 585,403 filed June 9, 1975.

The output pulse of switch means 22 on line 23 is supplied as the enable input to the AND gate 24 in each of the logic circuits 20. The other input to the AND gate 24 of the first logic circuit is the pulse on line L1 from counter circuit 11. If both the pulse on line L1 and the select pulse from switch 22 are applied to AND gate 24 contemporaneously, the AND gate 24 is enabled and has pulse output signal. The AND gate 24 and all other AND gates hereinafter mentioned make take any of a wide variety of forms which are well-known in the prior art to accomplish the AND logic operation. The output signal of gate 24 is applied to the input of memory latching means 25. The latching means 25 can be any bistable circuit which provides a continuous output signal upon receipt of an input signal until it is reset. In the preferred embodiment, the memory latching circuit 25 is a bistable flip-flop which provides an output signal upon the receipt of a set pulse from the AND gate 24 and further maintains its output signal until it is reset by a pulse from switch means 26 of the selection means 21. The switch means 26 is identical to the select switch means 22. It should be apparent to one of ordinary skill in the art that the memory latching circuit 25 could be a random access memory provided the appropriate standard addressing circuitry and other necessary circuitry well-known in the prior art were also included. The output of memory latching means 25 is applied as a first or enable input to AND gate 27. The second input to AND gate 27 is the sequence pulse from counter circuit 11 on line L1. To enable AND gate 27 the output from latch means 25 and the sequence pulse on line L1 must be synchronously applied to its input terminals.

The counter circuit 11 now produces a second sequence pulse on line L2 which energizes lamp 14. If the instrument player desires to set the second logic circuit 20, he depresses the switch means 22 while the lamp 14 is on and the same operation as described above occurs. However, if the instrument player desires not to set the second logic circuit 20 he merely refrains from actuating switch means 22 while lamp 14 is lit. The instrument player therefor can set as many of the logic circuits 20 and in any order as is desired to provide a selected rhythm pattern output to be applied to the voice generation circuit 16.

After the instrument player has programmed the desired rhythm pattern in the channel connected to the desired terminal of the voice generation circuit 16 corresponding to an unpitched musical instrument, the apparatus is set to operate in the play mode. Naturally additional rhythm channels connected to different input terminals of the voice generation circuit 16 can be programmed to produce a desired output pulse pattern. The rhythm channel B could be set as described above during the same cycle of counter circuit 11 when channel A is being set or during subsequent cycles to produce a different output pulse sequence which is applied to a different input terminal of the voice generation circuit 16.

To begin the play mode of operation, the switch means 12 of FIG. 1 is depressed to reset the counter circuit 11 which produces a first pulse output on line L1. The first pulse output on line L1 is applied to the first logic circuit in each rhythm channel A through N. As illustrated in FIG. 2, the first sequence pulse is applied as the first input to AND gate 24. The AND gate 24 is not enabled since there is no pulse output on line 23 from switch means 22. However, AND gate 27 also receives the pulse on line L1 from counter circuit 11 and if it has been set during the program mode, as described above, the enable output from the memory latching circuit 25 is present at its other input terminal. The AND gate 27 is thereby enabled or qualified and has an output pulse on line 28. Line 28 is connected to the output terminal of each AND gate 27 of each logic circuit 20 to supply the output pulses from the AND gates 27 as a control signal to the input terminal of the voice generation circuit 16. The counter circuit 11 continues to generate sequence pulses on lines L2 through L32 and the AND gates 27 of the corresponding logic circuits which were previously set will have an output signal pulses applied to line 28. In this manner a programmed rhythm pattern of pulses is applied as the control signal to the voice generation means 16. To provide additional playing versatility circuit connection is made from line 23 to the line 28. Therefore, even during the playing mode if the switch 22 is depressed a pulse signal will appear on line 28 which will be inserted into the programmed rhythm pattern and connected to the voice generation circuit means 16. In order to reset all of the memory latch circuits 25, the reset switch 26 is connected to each latching circuit 25. Therefore, to completely clear the rhythm channel, the reset switch 26 of the selection means 21 is depressed. Now a different rhythm pattern can be inserted into the channel. It should be noted that each individual memory circuit 25 can also be provided with an individual reset switch to clear that associated logic circuit only.

As an example of the operation of the programmable rhythm apparatus, assume the instrument player desires to select a rhythm pattern consisting of eight beats of quarter notes in two bars with the sound of a bass drum at every odd beat and a snare drum at every even beat. The rhythm channels with outputs connected to the bass drum terminal and the snare drum terminal respectively of the voice generation circuit 16 must be programmed. The switch 12 is turned which resets the counter circuit 11 and starts clock 10. If the output of rhythm channel A is connected to the bass drum terminal, the switch 22 of selection means 21 in Channel A must be depressed when a sequence pulse on line L1 lights lamp 13 and when subsequent sequence pulses on lines L9, L17 and L25 light their respective lamps. Now, the logic circuits 20 of channel A which correspond to lines L1, L9, L17 and L25 are set. If the output of channel B is connected to the snare drum terminal of the voice generation circuit 16, the switch 22 of selection means 21 of channel B must be depressed when a sequence pulse on lines L5, L13, L21 and L29 light their respective lamps. The rhythm channel B can be set as described during the same cycle of the counter circuit 11 when the rhythm channel A is being set or during a subsequent cycle in the program mode of operation. In either case, the logic circuits 20 of channel B corresponding to lines L5, L13, L21 and L29 are set. After the logic circuits 20 of both channel A and Channel B are thus set as desired, the next cycle of the counter circuit 11 will begin the playing mode of operation and will produce a control signal output from channel A on the first, ninth, 17th and 25th beat to control the bass drum output sound signal from the voice generation circuit 11. In addition, the same cycle of the counter circuit 11 will produce a control signal output from channel B on the fifth, 13th, 21st and 29th beat to control the snare drum output signal from the voice generation circuit 11. This programmed rhythm is repeated for each cycle of the counter circuit 11 during the playing mode of operation until the reset switch 26 of the selection means 21 for the respective channels A and B is depressed clearing the channels for receiving a new rhythm pattern.

Figure 3:
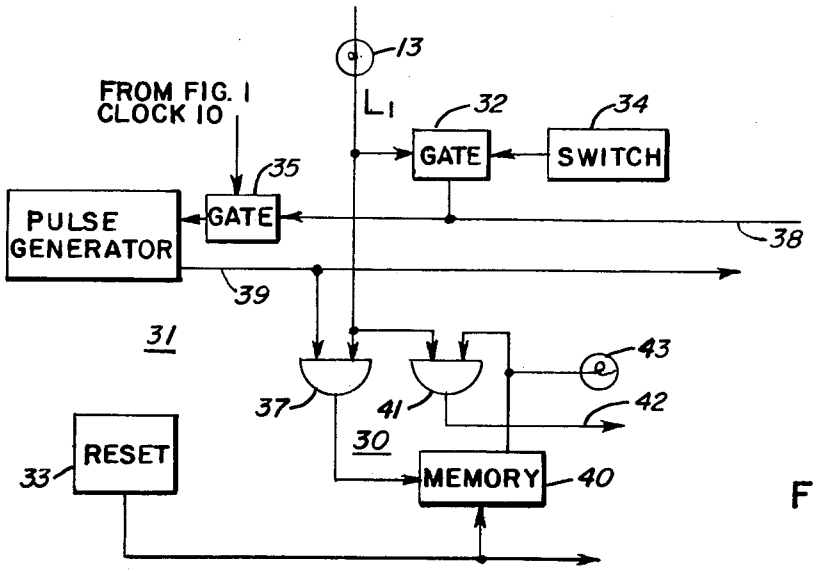
FIG. 3 is a schematic illustration of an alternative circuit for an individual programmable rhythm channel.

FIG. 3 illustrates an alternative form of logic circuit means and selection means for the rhythm channel. In FIG. 3, only a single logic circuit means 30 is illustrated for the sake of clarity but it is to be understood that a plurality of said circuit means 30 would be normally employed to comprise a single rhythm channel. The selection means 31 comprises a plurality of selection switches 34 and gates 32 corresponding to the number of logic circuit means 30 and a gate 35, a pulse generator means 36 and a reset switch 33.

The sequence pulse signal from counter circuit 11 is applied on line L1 in the same manner as previously described in FIG. 2. The pulse on line L1 is applied to the first input of gating circuit means 32 and is further applied to the first input of AND gate 37 of logic means 30. The gating circuit 32 can be any well-known circuit that only passes a signal when a gating or enable pulse is present. If the instrument player closes selection switch element 34 when the pulse on line L1 lights lamp 13 and enable pulse is supplied to gating circuit 32 to produce an output pulse on line 38 to the first input of timing gate circuit 35. The line 38 is connected to the output of each gate 32 of each selection means 31 for the rhythm channel. The second input of timing gate circuit 35 is obtained from the clocking pulse circuit 10 of FIG. 1. The gating circuit 35 is enabled or qualified only during every half cycle of output pulse from the clock 10 to control the pulse output of generator 36 even if several selection switches 34 in several logic circuits 30 of the same rhythm channels are simultaneously depressed. The gate circuit 35 can also be any well-known circuit that passes a signal only when an enable pulse is present. Therefore, if the inputs are synchronously applied the gate 35 is enabled. When the gate 35 is thus enabled, its output pulse signal activates pulse generator 36 to produce an output pulse on line 39. The pulse generator can be any type well-known in the prior art.

The output pulse on line 39 is supplied as the second input to AND gate 37 of each logic circuit means 30. If the pulse on line 39 and the pulse on line L1 arrive contemporaneously as the inputs for AND gate 37, the gate will be enabled to have a pulse output signal which is applied to memory latching circuit 40. The memory latching circuit 40 can be any standard well-known device which upon receipt of an input signal will main an output signal until reset. In the preferred embodiment, the memory latching circuit 40 comprises a standard bistable flip-flop which is reset by the depression of switch 33 of the selection means 31. The output of memory circuit 40 is supplied as the first input to AND gate 41. The output of the memory latching circuit 40 also energizes indicating means 43 to signify that the memory latching circuit 40 has been successfully activated. In the preferred embodiment, the indicating means 43 is a lamp. A similar indicating means could be connected to the output of the memory circuit 25 in FIG. 2.

During the playing mode, subsequent pulses on line L1 will be applied at the second input of AND gate 41 and with the output pulse from memory circuit 40 will enable and AND gate 41 providing an output pulse signal on line 42 to be applied to the standard voice generation circuit 16 of FIG. 1. The output of each AND gate 41 of each logic circuit 30 is connected to the line 42 to provide a pulse output pattern acting as a control signal for the voice generation circuit 16. Since the activation of the memory latching circuit 40 energizes the lamp 43, the instrument player can now visually determine whether the rhythm channel has been successfully programmed to provide the desired output rhythm pattern. The subsequent operation of the rhythm channel in the playing mode of operation and the selection of desired rhythm patterns is identical to that described in relation to FIG. 2.

FIG. 4 illustrates an alternative embodiment of the present invention wherein the output pulse sequence from each rhythm channel A through N is not applied directly to the standard voice generation circuit 16 but rather the pulse sequence output of each rhythm channel is first applied to a switching network 50. The switching network 50 enables the instrument player to arrange an increased complexity of rhythm patterns without the necessity of having a large number of rhythm channels. The switching network 50 comprises a plurality of individual switch units 51 corresponding to the number of rhythm channels. The individual switch unit 51 has a plurality of stationary contacts each connected to an individual input terminal of the voice generation circuit and a movable contact connected to an individual rhythm channel.

If the instrument player has programmed the rhythm channel A to produce a desired sequence of output pulses to control the cymbal output signal from the voice generation circuit 16, the switch unit 51 corresponding to the output of channel A will be connected to the stationary contact 3 which is connected to the cymbal terminal of voice generation circuit 16. Similarly, the pulse sequence output from the remaining rhythm channels B through N are connected to corresponding switches 51 which can selectively be moved to different stationary terminals which are connected to the input terminals of the voice generation circuit 16. If the same pulse pattern used for the cymbal rhythm previously programmed in channel A is subsequently desired to be used for the snare drum, a resetting of the desired pulse pattern in a different rhythm channel B through N is not necessary. The desired result is obtained by merely resetting the switch unit 51 corresponding to the Channel A output pulse pattern so that its movable contact is connected to stationary terminal 2 which corresponds to the snare drum input of the voice generation circuit 16 provides. This type of switching network 50 interposed between the outputs of the individual rhythm channels A through N and the standard voice generation circuit 16 introduces greater flexibility and selection for the programmable rhythm device.

FIG. 5 is an alternative embodiment of the present invention which enables additional variation in the selected rhythm pattern by the instrument player. Output signals from the counter circuit 11 are applied both to the programmable rhythm channels A through N as illustrated in FIG. 1 and also to a standard rhythm selection matrix 52. The rhythm matrix 52 is standard and well-known in the art and comprises a selection of predetermined rhythm patterns which when applied to the voice generation circuit 16 and transducer 17 will produce the desired rhythm output sound. Each output from standard rhythm device 52 is connected to a corresponding cancel switch 53. If all of the cancel switches 53 are closed and no programmable rhythm has been set in the rhythm channels A through N, the signals supplied to the voice generation circuit 16 from the rhythm selection matrix 52 will produce a standard predetermined rhythm pattern for the individual unpitched musical instruments. Thus, if the rhythm matrix 52 is set to produce the standard rhythm for a waltz including the bass drum, snare drum and cymbal and the cancel switches 53 are all closed, the voice generation circuit 16 will produce the standard rhythm pattern output.

To provide a variation in the standard rhythm pattern, the instrument player can open a selected one or more of the cancellation switches 53 which correspondingly removes the predetermined rhythm pulse pattern from being applied from rhythm matrix 52 to the voice generation circuit 16. If the cancel switches 53 corresponding to the standard pulse pattern supplied to the bass drum and snare drum terminals of voice generation circuit 16 are opened and in place of this standard rhythm pulse a programmable rhythm pulse pattern in corresponding rhythm channels connected through switching network 50 to the bass and snare drum terminals is applied, these programmed pulse pattern output signals control the voice generation circuit 16 together with the remaining standard rhythm pulse pattern applied to the cymbal terminal. Thus, any combination of programmed pulse patterns and standard pulse patterns can be arranged. The voice generation circuit will receive the programmed pattern from the rhythm channels on the cancelled input lines and the other uncancelled input lines of the voice generation circuit will receive the standard predetermined rhythm pattern. Thus, if several unpitched rhythm instrument sound output signals are desired from the voice generation circuit, one or more of these can be varied by the instrument player by merely opening the appropriate cancel switch 53 thereby removing the standard rhythm pattern from the voice generation circuit 16 and substituting in its stead a programmed pulse pattern from the appropriate rhythm channels A through N. This greatly reduces the number of rhythm channels necessary and further increases flexibility.

FIG. 6 illustrates a further embodiment of the present invention in which the function of the cancel switches of FIG. 5 is combined into the operation of the switching network 55. The switching network 55 comprises a plurality of switch units 54 corresponding to the number of input terminals of the voice generation circuit 16 and which are adapted to receive the programmable pulse output sequence from the rhythm channels A through N. Each switch unit 54 comprises a movable contact arm X and a plurality of stationary contacts A, B and C. The movable contact arm X of each switch unit 54 is connected to an input terminal of the voice generation circuit 16. The first stationary contact A of each unit 54 is connected to an output line of the standard rhythm matrix 52. The second stationary contact B of each unit 54 is connected to a corresponding output of a rhythm channel A through N. The third stationary contact C of each switch unit 54 is connected to the output pulse pattern of a different rhythm channel than the stationary contact B. In the preferred embodiment, the stationary contact C is connected to the pulse output sequence of the adjacent rhythm channel thereby necessitating the last switch unit 54 to have only stationary contacts A and B. However, it should be apparent that other switching arrangements can be used.

In FIG. 6, if the first switch unit 54, connected to the bass drum input terminal of voice generation circuit 16 has its movable contact arm X connected to stationary contact C, then the pulse output pattern of rhythm Channel B is applied to the bass drum input terminal. If the second switch unit 54, connected to the snare drum input terminal of the voice generation circuit 16 has its movable contact arm X connected to its stationary contact B then the pulse output pattern of rhythm channel B is also applied to the snare drum terminal. Thus, the pulse output sequence of a single rhythm channel A though N controls the rhythm pattern of two unpitched musical instruments. As a further modification, selected output lines from the standard rhythm matrix 52 can be connected directly to the voice generation circuit 16 bypassing the switching network 55 (not illustrated). It is to be understood that other arrangements of the switching unit 55 in conjunction with the standard rhythm matrix outputs and the input terminals of the voice generation circuit 16 are within the scope of the invention.

It is to be understood that the present disclosure can be modified or varied by applying current knowledge without departing from the spirit and scope of the novel concepts of the invention.

I claim:

1. A programmable rhythm device for use in an electronic musical instrument comprising:

a pulse producing means for generating a sequence of pulses respectively corresponding to each individual beat of a rhythm pattern, a plurality of rhythm channels each receiving each pulse in said pulse sequence and each of said rhythm channels being individually programmable by an instrument player for producing an output control signal at selectable times corresponding to any desired beat of a rhythm pattern, and, said plurality of rhythm channels each comprising:

a selection means for generating an enable signal, and, a plurality of logic circuit means each responsive to the simultaneous occurrence of said selection enable signal and one of said sequence pulses for programming said logic circuit.

2. A device as set forth in claim 1 wherein said programmed logic circuits pass subsequent sequence pulses corresponding to desired beats of a rhythm pattern.

3. A device as set forth in claim 1 wherein each of said logic circuit means comprises:

a first AND gate responsive to said selection enable signal and said sequence pulse for producing a set output signal, a memory latching means responsive to said first AND gate for maintaining a latching enable signal output upon receipt of said set signal, and a second AND gate responsive to said latching enable signal and said sequence pulse for producing a pulse output.

4. A device as set forth in claim 3 wherein said logic circuit is programmed to pass said subsequent sequence pulses when said second AND gate receives said latching enable signal.

5. A device as set forth in claim 4 wherein said output pulse from each of said second AND gates combines to form said output control signal at the desired rhythm.

6. A device as set forth in claim 5 wherein said logic circuit means further comprises:

an indicator means responsive to said latching enable signal for indicating said logic circuit is programmed.

7. A device as set forth in claim 1 wherein said selection means further comprises:

at least one momentary selection switch means corresponding to each of said rhythm channels for enabling said instrument player to program said logic circuits.

8. A device as set forth in claim 1 further comprising:

a voice generation circuit means responsive to said output control signal of each of said rhythm channels for producing a signal representative of an unpitched musical instrument at said programmed rhythm, and a transducer responsive to said voice generation circuit means for producing an audible sound output simulating said unpitched musical instruments at said programmed rhythm.

9. A device as set forth in claim 8 further comprising:

a switching network responsive to said output control signal of each of said plurality of rhythm channels for connecting each of said output control signals to said voice generation circuit.

10. A device as set forth in claim 9 further comprising:

a fixed rhythm matrix responsive to said pulse producing means for generating output pulse sequences in a predetermined standard pattern, and said standard output pulse sequence being applied to said switching network for permitting the instrument player to apply said programmed output control signals or said standard output pulse sequences to said voice generation circuit.

* * * * *